US005319427A

United States Patent [19]

Sakurai et al.

[11] Patent Number: 5,319,427

[45] Date of Patent: Jun. 7, 1994

[54] IMAGE FIXING ROTATABLE MEMBER AND IMAGE FIXING APPARATUS USING SAME

[75] Inventors: Masaaki Sakurai, Yokohama; Kazuo Kishino, Kawasaki; Toshiyuki Miyabayashi, Tokyo, all of Japan

[73] Assignee: Canon Kabushiki Kaisha, Tokyo, Japan

[21] Appl. No.: 26,622

[22] Filed: Feb. 26, 1993

Related U.S. Application Data

[63] Continuation of Ser. No. 281,759, Dec. 9, 1988, abandoned.

[30] Foreign Application Priority Data

Dec. 14, 1987 [JP] Japan ..... 62-315491

[51] Int. Cl.[5] ..... G03G 15/20; G03G 21/00

[52] U.S. Cl. ..... 355/285

[58] Field of Search ..... 355/282, 285, 289, 290, 355/295

[56] References Cited

U.S. PATENT DOCUMENTS

| | | | |
|---|---|---|---|
| 4,064,313 | 12/1977 | Takiguchi et al. | 428/447 |
| 4,078,286 | 3/1978 | Takiguichi et al. | 29/132 |
| 4,149,797 | 4/1979 | Imperial | 355/290 |
| 4,264,181 | 4/1981 | Lentz et al. | 355/290 X |
| 4,272,179 | 6/1981 | Seanor | 355/289 |
| [illegible] | [illegible] | Inagaki et al. | 355/290 X |
| 4,501,482 | 2/1985 | Stryjewski | 355/290 |
| 4,518,244 | 5/1985 | Kageyama et al. | 355/289 X |
| 4,567,349 | 1/1986 | Henry et al. | 355/290 X |
| 4,588,279 | 5/1986 | Fukuchi et al. | 355/271 |
| 4,596,920 | 6/1986 | Inagaki | 355/290 X |
| 4,616,917 | 10/1986 | Sakurai | 355/290 X |
| 4,727,394 | 2/1988 | Bov et al. | 355/290 |
| 4,810,564 | 3/1989 | Takahashi et al. | 355/290 X |
| 4,829,931 | 5/1989 | Mogi | 118/60 |
| 5,011,401 | 4/1991 | Sakurai et al. | 355/282 X |

FOREIGN PATENT DOCUMENTS

| | | |
|---|---|---|
| 3539377 | 5/1986 | Fed. Rep. of Germany . |
| 60-205561 | 10/1985 | Japan . |
| 61-38957 | 2/1986 | Japan . |
| 61-158361 | 7/1986 | Japan . |
| 61-250668 | 11/1986 | Japan . |

*Primary Examiner*—Fred L. Braun

*Attorney, Agent, or Firm*—Fitzpatrick, Cella, Harper & Scinto

[57] ABSTRACT

An image fixing rotatable member including a base member; a silicone rubber layer on the base member; a primer layer on the silicone rubber layer; and a fluorine resin layer on the primer layer; wherein the primer layer is binder material containing the fluorine resin and aminosilane compound.

18 Claims, 2 Drawing Sheets

IMAGE FIXING ROTATABLE MEMBER AND IMAGE FIXING APPARATUS USING SAME

This application is a continuation of application Ser. No. 07/281,759 filed Dec. 9, 1988, now abandoned.

FIELD OF THE INVENTION AND RELATED ART

The present invention relates to an image fixing rotatable member and an image fixing apparatus using the same, usable with an electrophotographic apparatus such as a copying apparatus, a laser beam printer and an electrostatic recording apparatus such as a multi-stylus printer, more particularly to an image fixing rotatable member or an image fixing apparatus using the same for fixing an unfixed image on a recording material.

As for an image fixing apparatus for fixing an image, a type wherein heat and/or pressure is applied to the unfixed image made of toner by a roller or a pair of rollers, is widely used.

In such an apparatus, it is required that the toner off-set is prevented, and therefore, that the surface of the roller has sufficient releasing properties. This requirement is particularly significant in such an fixing apparatus wherein the toner is fused by heat.

Further, the fixing roller is required to have recording material conveying properties, resistance to wear, image fixing properties, durability or the like under difficult ambient conditions.

In order to meet those requirements, the image fixing roller, particularly a heating roller for applying heat to the toner, is coated with fluorine resin 32 such as PTFE and PFA resins having good releasability, on a core metal 31, as shown in FIG. 3A by a reference numeral 33, for example, which is widely used.

The fixing roller is good in the releasability and durability, but since the resin layer is hard, the recording material conveying property and the image fixing property are not sufficient.

When the fixing roller is an elastic roller 44 having a core metal 41 and an elastic layer such as silicone rubber and fluorine resin or the like, as shown in FIG. 3B, the problem of the image fixing properties and the recording material conveying properties involved in the resin roller are good in the initial stage of use, but the durability of the surface of the roller is poor, and therefore, the surface of the rubber is deteriorated with long term use with the result of poor releasability. Then, the off-set preventing property and the conveying properties are deteriorated with the result of wrinkle and curl. Also, when the roller is subjected to an overload, the roller is easily damaged.

Therefore, it has been difficult to maintain both of the image fixing properties and the releasing properties for a long period. In order to solve the problem U.S. Pat. No. 4,824,752 and Ser. No. 522,460, now U.S. Pat. No. 5,011,401 all of which have been assigned to the assignee of this application have proposed a roller, as shown in FIG. 3C, having a core metal 51 coated with an elastic layer 52 made of silicone rubber, fluorine rubber or the like, which is in turn coated with a resin layer 53 made of PTFE, PFA resin or the like.

However, in the roller shown in FIG. 3C, the affinity between the elastic layer and the resin layer is not sufficient, so that the bonding therebetween is insufficient with the possible result of the resin layer partly peeling off the elastic layer.

SUMMARY OF THE INVENTION

Accordingly, it is a principal object of the present invention to provide an image fixing rotatable member wherein the peeling strength between the fluorine resin layer and the silicone rubber is strong.

It is another object of the present invention to provide an image fixing apparatus using an image fixing rotatable member having a high peeling strength between the fluorine resin layer and the silicone rubber layer.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

The inventors have made various investigations and experiments for improving an image fixing roller having a resin layer on an elastic layer, which involves both of various advantages and some problems, and found that high durability to wear, good releasing properties, image fixing properties and recording material conveying properties can be provided for a long period of time by providing a primer layer made of binder material containing aminosilane compound between the silicone rubber elastic layer and the fluorine resin coating layer.

In conjunction with the accompanying drawings, an image fixing roller and an image fixing apparatus using the same will be described in detail.

Figure 1:
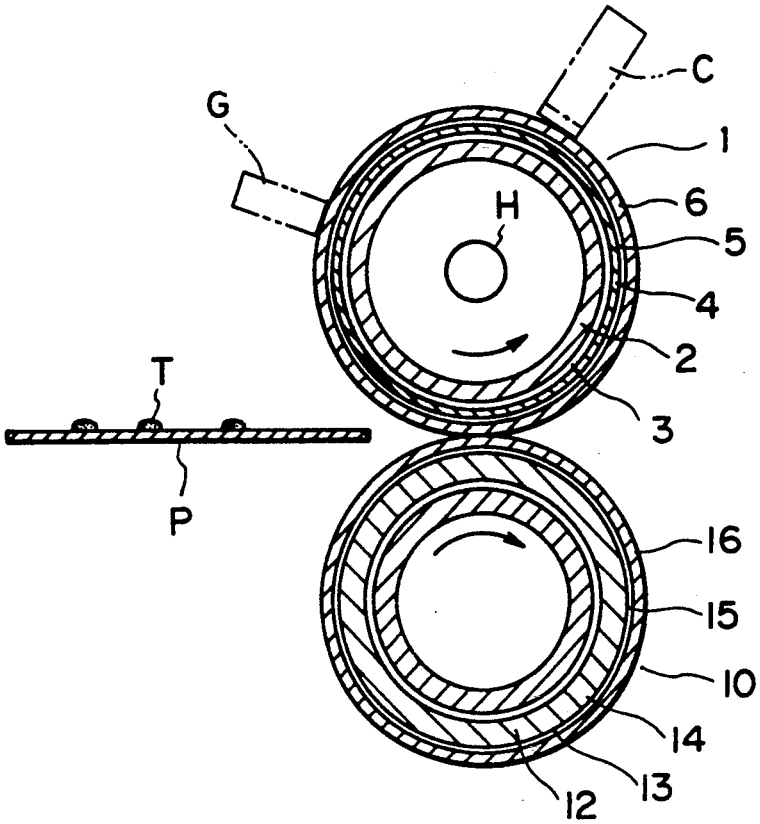
FIG. 1 is a sectional view of an image fixing apparatus according to an embodiment of the present invention.
Figure 2:
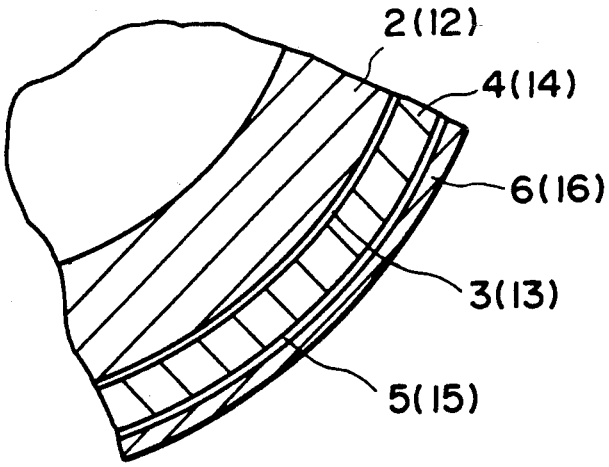
FIG. 2 is an enlarged view of a part of a heating roller of the apparatus shown in FIG. 1.
Figure 3A:
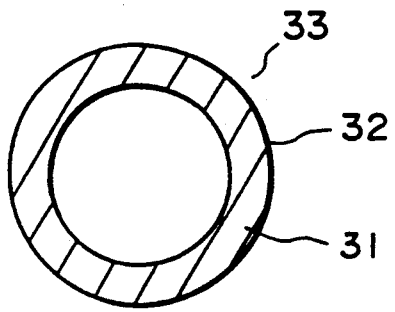
FIG. 3A PRIOR ART
FIGS. 3A, 3B and 3C are sectional views of conventional heating rollers.
Figure 3B:
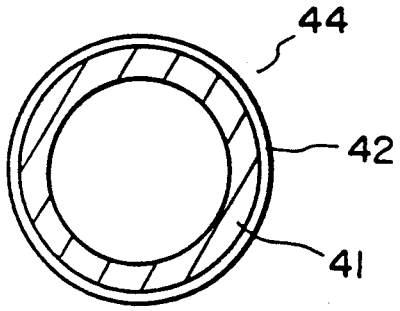
FIG. 3B PRIOR ART
Figure 3C:
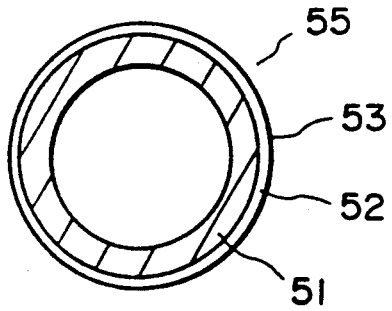
FIG. 3C PRIOR ART

Referring now to FIG. 1, there is shown an image fixing apparatus in cross-section, using the image fixing roller according to the present invention. FIG. 2 is an enlarged sectional view of a major part of the fixing roller.

The image fixing apparatus comprises a heating roller 1 having a heating source H therein and contactable with a toner image T which is unfixed and carried on a recording sheet P of paper and a back-up or pressing roller 10 for pressing the recording sheet P carrying the toner image to the heating roller 1. Each of the heating roller 1 and the pressing roller 10 comprises a core metal 2 or 12 made of metal, a first primer layer 3 or 13 of silane material, an elastic layer 4 or 14 of silicone rubber, a second primer layer 5 or 15 of binder material containing fluorine resin and aminosilane compound, and a fluorine resin layer 6 or 16 having good releasing properties for preventing toner off-set, in the order named from the inside thereof. The fixing apparatus further comprises temperature control means G for detecting a temperature of the surface of the fixing roller 1 and to control the amount of heat generation by the heater H to provide an optimum surface temperature for fusing the toner, for example, a predetermined temperature between 160°-200° C. The fixing apparatus further comprises toner off-set preventing liquid applying means C for applying toner off-set preventing liquid such as silicone or the like on the surface of the heating roller 1 and other means.

The core metal 2 is preferably made of a high thermal conductivity material such as aluminum. The first primer layer of silane material is made of, for example, DY 39-012, available from Toray Silicone Kabushiki Kaisha, Japan. The silicone rubber is not limited but is preferably vulcanized silicone rubber mainly made of high polymer polyorganosiloxane and added with a great amount of extender filler material such as quartz powder, and having a rubber hardness of 40–95 degrees (JIS A), particularly 60–80 degrees.

On the elastic layer 4, a second primer layer 5 made of binder material containing fluorine resin material and aminosilane compound is formed. The fluorine resin is contained in order to strengthen the contact with the upper layer, that is, the fluorine resin coating layer, and it may be of monopolymer or copolymer of tetrafluoroethylene. The main content of the binder material is a heat resistive resin material having good affinity with the fluorine resin, for example, aromatic polyamideimide resin, polyimide resin, polyarylenesulfide resin such as polyphenylene sulfide resin, and silicon compound such as alkali or amine silicate, alkyl silicate, lithium polysilicate or silca colloid.

By containing the aminosilane compound, the affinity of the silicone rubber is assured. Typical examples thereof are, α-aminopropyltriethoxysilane, N-β-aminoethyl-α-aminopropyltrimethoxysilane, N-(trimethoxysilylpropyl)ethylenediamine, N-,β-aminoethyl-α-aminopropylmethyldimethoxysilane, α-ureidepropyltriethoxysilane, β-aminoethyl-,β-aminoethyl-α-aminopropyltrimethoxysilane. The content of the aminosilane compound is preferably 1–30 parts, further preferably 1–20 parts, by weight on the basis of 100 parts by weight of the binder material. It is prepared as aqueous dispersion, which is the second primer.

On the second primer layer 5, a resin layer having a good resistance to wear, more particularly, a fluorine resin layer 6 having also good releasing properties, is formed.

The material of the resin layer 6 is preferably PFA resin (copolymer of tetrafluoroethylene resin and perfluoroalkoxyethylene resin) or PTFE resin (tetrafluoroethylene resin).

The pressing roller 10 will be described.

The pressing roller 10 has a similar structure, and the core metal 12 is made of stainless or another steel, and on the core metal 12 a (first) primer layer 13 of silane material is formed. On the first primer layer 13 an elastic layer 14 of silicone rubber having good thermal conductivity is formed.

The silicone rubber of the elastic layer may be made of the same material as the heating roller 1, but the rubber hardness is preferably lower than that of the heating roller in order to assure a sufficient width of a nip formed with the heating roller, more particularly 20–60 degrees (JIS A), further preferably 30–50 degrees.

On the elastic layer 14, a second primer layer 15 made of a binder material containing fluorine resin and aminosilane compound is formed.

On the second primary layer 15, a resin layer, more particularly a fluorine resin layer 16 of PFA resin or PTFE resin or the like is formed.

The heating roller 1 is preferably reversely crowned, that is, the diameter thereof at the longitudinal center is slightly smaller than that of the longitudinal ends thereof.

As described, the fixing roller of the present invention is provided a silicone rubber elastic layer 4 or 14 and a fluorine resin coating layer 6 or 16 with a primer layer made of a binder material containing fluorine resin and the aminosilane compound exhibiting good contactness or affinity with those layers, and therefore, the bonding and contactness properties with the elastic layer 4 or 14 and with the resin layer 6 or 16 are excellent, so that the surface layer is prevented from partly peeling for a long period of time, without deterioration of the elasticity of the elastic layer. Thus, the problem of the surface layer being partly removed is solved, and therefore, the advantages of the roller having the resin layer on the elastic layer are used to the maximum extent.

The method of manufacturing the heating roller 1 and the pressing roller 10 according to the embodiment will be described.

For the manufacturing of the heating roller 1, a core metal 2 is made of aluminum so as to be reversely crowned and to have a thickness of 6.5 mm and the outer diameter of 58.3 mm at the longitudinal center thereof (amount of reverse crown is 150 microns). The surface thereof is sand-blasted to be degreased and is dried. Then, silane primer DY 39-012 available from Toray Silicone Kabushiki Kaisha, Japan is applied thereon in a thickness of 7 microns, and it is heated at 120° C. for 20 minutes. Thereafter, a heat-vulcanized silicone rubber sheet having a good thermal conductivity is wrapped, and is press-vulcanized at 160° C. for 30 minutes. The rubber was machined to have a thickness of 0.5 mm. Thus, the silicone rubber roller is produced.

The wrapped silicone rubber sheet is produced by kneading the following and is formed into a sheet having a thickness of approximately 2 mm:

| | |
|---|---|
| Rubber stock SE1186: (Toray Silicone Kabushiki Kaisha) | 100 |
| Iron Oxide Red CP21: (Toray Silicone Kabushiki Kaisha) | 2 |
| Cross Rinker RC4: (Toray Silicone Kabushiki Kaisha) [2,5-dimethyl-2,5-(tert-butylperoxy)-hexane 50% paste] | 0.8 |
| Quartz powder crystelite VX-S: (Tsuchiya Kaorin Kabushiki Kaisha) | 80 |

A mixture of a first component which is TPS (Liton U-I) available from Phylips, U.S.A. particulated to the average particle size of 10 microns and a second component which contains liquid solution of N-methylpyrrolidone (polyamideimide (PAI) resin), available from ROAN PULAN under the trade name of Rodephtal R200) having a concentration of 30% and aqueous dispersion of polyamideimide (resin content of approximately 30% and surface active agent content of 10%/PAI) produced by pulverizing and mixing for 48 hours by ball mill ion exchange water and acrylic sodium sulfate are prepared. The first component and the second component are mixed so that PPS/PAI is 10/1, and it was pulverized and mixed for 20 hours in a ball mill, and the product is mixed with 60% PTFE suspension (polyflon dispersion D-I available from Daikin Kabushiki Kaisha, Japan) and α-aminopropyltriethoxysilane so that the weight ratio PAI+PPS/PTFE/α-aminopropyltriethoxysilane is 100/100/20, by which a aqueous dispersion is prepared as for the primer. The primer is applied on the silicone rubber layer and is dried at the temperature of 100° C. and then, the roller is kept under a low temperature condition of 10° C. After a sufficient period of time, PTFE solution is applied by a roll coater under a temperature of 10° C. in a thickness of 20 microns, and is dried for three minutes under 250° C. The fluorine resin liquid is coated under a low temperature condition because the fluorine resin is prevented from cracking during the drying process.

The roller thus produced is maintained in an oven and is heated at 450° C. for 2 minutes to sinter the PTFE resin, and then it is quickly cooled.

by the quick cooling after the sintering, a sintered fluorine resin layer having a degree of crystallinity of not more than 95%, a tensile strength of not less than 50 $kg/cm^2$ and a contact angle relative to water of not less than 100 degrees is formed on the silicone rubber roller with a high bonding strength and with sufficient thickness.

By producing the surface layer by sintering resin liquid, it is bonded with resin powder in the primer layer, and therefore, a strong bonding can be produced.

The resin material mixed in to the primer layer is preferably the same as the surface layer.

An image fixing durability test was performed using the heating and pressing rollers produced in the manner described above. The surface temperature of the heating roller 1 was controlled at 180° C., and the sheet feeding speed was 440 mm/sec, and the process speed was 70 sheets (A4)/minute. The image fixing properties were good when the temperature is 15° C., and the amount of toner off-set was as small as one fifth the conventional off-set amount. Even when the temperature was 3.25° C. and the humidity was 85%, the transfer sheet was not wrinkled, and the curling was very small so that the sheets were properly stacked on a sorter or the like. The image was not collapsed, and the quantity of the image was good.

Those good conditions were maintained even after 300,000 sheets were processed by the pressing and heating rollers, and there was not observed any problem even after 500,000 sheets were processed.

The image fixing roller described in the foregoing is preferably used for each of the heating and pressing rollers, but the advantages can be provided if it is used for one of the rollers. However, it is preferably that the present invention is used at least for the lower contactable with the unfixed image.

While the invention has been described with reference to the structures disclosed herein, it is not confined to the details set forth and this application is intended to cover such modifications or changes as may come within the purposes of the improvements or the scope of the following claims.

What is claimed is:

1. An image fixing rotatable member comprising:

a silicone rubber layer;

a fluorine resin layer; and a primer layer for bonding said silicone rubber layer to said fluorine resin layer, wherein said primer layer includes a silane compound, a fluorine resin material in an amount grater than the silane compound and a binder material in an amount greater than said silane compound, said binder material comprising polyamideimide resin, polyimide resin, polyarylenesulfide resin, or silicone compound.

2. A member according to claim 1, wherein said fluorine resin layer is produced by applying and sintering a fluorine resin material.

3. A member according to claim 1, wherein said primer layer comprises a silane compound of 1–30% by weight based on the weight of binder resin of said primer layer.

4. A member according to claim 3, wherein said primer layer comprises a silane compound of 1–20% by weight based on the weight of binder resin of said primer layer.

5. A member according to claim 1, wherein said silane compound is an aminosilane compound.

6. A member according to claim 1, further comprising a base member on which said silicone rubber layer is provided, and an additional primer layer for bonding said base member and said silicone rubber layer, wherein said additional primer layer contains a silane compound.

7. A member according to claim 1, wherein said primer layer is provided by applying an aqueous dispersion comprising binder resin material, a fluorine resin material and the silane compound on said silicone rubber layer and then removing the aqueous content thereof.

8. A member according to claim 1, wherein the fluorine resin contained in said primer layer and a resin material of said fluorine resin layer are PTFE or PFA.

9. A fixing apparatus comprising:

a pair of rotatable member forming a nip therebetween through which an image carrying member carrying an unfixed toner image is passed to fix the unfixed toner image;

at least one of said rotatable members comprising:

a silicone rubber layer;

a fluorine resin layer; and a primer layer for bonding said silicone rubber layer to said fluorine resin layer, wherein said primer layer includes a silane compound, a fluorine resin material in an amount greater than the silane compound and a binder material in an amount greater than said silane compound, said binder material comprising polyamideimide resin, polyimide resin, polyarylenesulfide resin, or silicone compound.

10. An apparatus according to claim 9, wherein at least one of the rotatable members is a rotatable member contactable to the unfixed toner image and is heated by a heating source.

11. An apparatus according to claim 9, wherein at least one of the rotatable members is a rotatable member not contactable to the unfixed toner image.

12. An apparatus to claim 9, wherein said fluorine resin layer is produced by applying and sintering a fluorine resin material.

13. An apparatus according to claim 9, wherein said primer layer comprises a silane compound of 1–30% by weight based on the weight of binder resin of said primer layer.

14. An apparatus according to claim 13, wherein said primer layer comprises a silane compound of 1–20% by weight based on the weight of binder resin of said primer layer.

15. An apparatus according to claim 9, wherein said silane compound is an aminosilane compound.

16. An apparatus according to claim 9, further comprising a base member on which said silicone rubber layer is provided, and an additional primer layer for bonding said base member and said silicone rubber layer, wherein said additional primer layer contains a silane compound.

17. An apparatus according to claim 9, wherein said primer layer is provided by applying an aqueous dispersion comprising binder resin material, the fluorine resin material, and the silane compound on said silicone rubber layer and then removing the aqueous content thereof.

18. An apparatus according to claim 9, wherein said fluorine resin material contained in said primer layer and a resin material of said fluorine resin layer are PTFE or PFA.

* * * * *

UNITED STATES PATENT AND TRADEMARK OFFICE

CERTIFICATE OF CORRECTION

PATENT NO. : 5,319,427
DATED : June 7, 1994
INVENTOR(S) : MASAAKI SAKURAI, ET AL.

It is certified that error appears in the above-indentified patent and that said Letters Patent is hereby corrected as shown below:

Column 1,
line 25, "an" should read --a--.

Column 3,
line 30, "N-,ß-" should read --N-ß- --; and
line 32, "ß-aminoethyl-,ß-" should read --ß-aminoethyl-ß- --.

Column 5,
line 14, "by" should read --By--;
line 24, "in to" should read --into--; and
line 64, "grater" should read --greater--.

Column 6,
line 30, "member" should read --members--; and
line 52, "apparatus" should read --apparatus according--.

Signed and Sealed this

Tenth Day of January, 1995

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,319,427

DATED : June 7, 1994

INVENTOR(S) : Sakurai. et al

It is certified that error appears in the above-identified patent and that said Letters Patent is hereby corrected as shown below:

The title page, should be deleted to be replaced with the attached title page.

Signed and Sealed this

Seventeenth Day of October, 1995

*Attest:*

Bruce Lehman

BRUCE LEHMAN

*Attesting Officer*

*Commissioner of Patents and Trademarks*

United States Patent [19]

Sakurai et al.

[11] Patent Number: 5,319,427

[45] Date of Patent: Jun. 7, 1994

[54] IMAGE FIXING ROTATABLE MEMBER AND IMAGE FIXING APPARATUS USING SAME

[75] Inventors: Masaaki Sakurai, Yokohama; Kazuo Kishino, Kawasaki; Toshiyuki Miyabayashi, Tokyo, all of Japan

[73] Assignee: Canon Kabushiki Kaisha, Tokyo, Japan

[21] Appl. No.: 26,622

[22] Filed: Feb. 26, 1993

Related U.S. Application Data

[63] Continuation of Ser. No. 281,759, Dec. 9, 1988, abandoned.

[30] Foreign Application Priority Data

Dec. 14, 1987 [JP] Japan ..... 62-315491

[51] Int. Cl.[5] ..... G03G 15/20; G03G 21/00

[52] U.S. Cl. ..... 355/285

[58] Field of Search ..... 355/282, 285, 289, 290, 355/295

[56] References Cited

U.S. PATENT DOCUMENTS

| | | | |
|---|---|---|---|
| 4,064,313 | 12/1977 | Takiguchi et al. | 428/447 |
| 4,078,286 | 3/1978 | Takiguichi et al. | 29/132 |
| 4,149,797 | 4/1979 | Imperial | 355/290 |
| 4,264,181 | 4/1981 | Lentz et al. | 355/290 X |
| 4,272,179 | 6/1981 | Seanor | 355/289 |
| 4,470,688 | 9/1984 | Inagaki et al. | 355/290 X |
| 4,501,482 | 2/1985 | Stryjewski | 355/290 |
| 4,518,244 | 5/1985 | Kageyama et al. | 355/289 X |
| 4,567,349 | 1/1986 | Henry et al. | 355/290 X |
| 4,588,279 | 5/1986 | Fukuchi et al. | 355/271 |
| 4,596,920 | 6/1986 | Inagaki | 355/290 X |
| 4,616,917 | 10/1986 | Sakurai | 355/290 X |
| 4,727,394 | 2/1988 | Bov et al. | 355/290 |
| 4,810,564 | 3/1989 | Takahashi et al. | 355/290 X |
| 4,829,931 | 5/1989 | Mogi | 118/60 |
| 5,011,401 | 4/1991 | Sakurai et al. | 355/282 X |

FOREIGN PATENT DOCUMENTS

| | | |
|---|---|---|
| 3539377 | 5/1986 | Fed. Rep. of Germany . |
| 60-205561 | 10/1985 | Japan . |
| 61-38957 | 2/1986 | Japan . |
| 61-158361 | 7/1986 | Japan . |
| 61-250668 | 11/1986 | Japan . |

*Primary Examiner*—Fred L. Braun

*Attorney, Agent, or Firm*—Fitzpatrick, Cella, Harper & Scinto

[57] ABSTRACT

An image fixing rotatable member including a base member; a silicone rubber layer on the base member; a primer layer on the silicone rubber layer; and a fluorine resin layer on the primer layer; wherein the primer layer is binder material containing the fluorine resin and aminosilane compound.

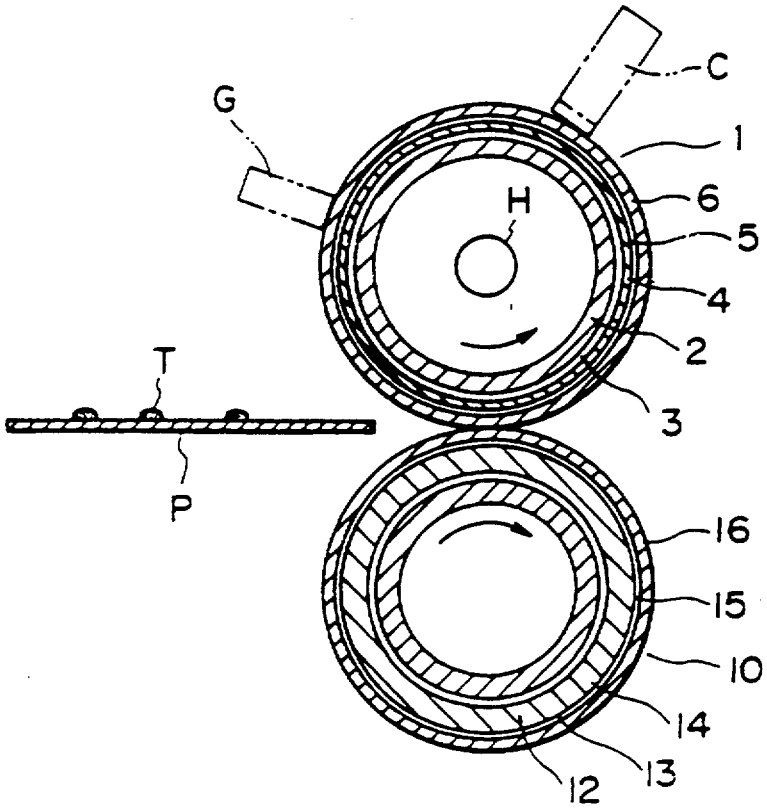

18 Claims, 2 Drawing Sheets